US009903591B2

(12) United States Patent
Atemboski et al.

(10) Patent No.: US 9,903,591 B2
(45) Date of Patent: Feb. 27, 2018

(54) WOOD BURNING FIREPLACE ASSEMBLY WITH AUTOMATIC IGNITER

(71) Applicant: Travis Industries, Inc., Mukilteo, WA (US)

(72) Inventors: Alan R. Atemboski, Renton, WA (US); Kurt W. F. Rumens, Kirkland, WA (US); Russell A. McBrien, Mukilteo, WA (US); William Ross Fotheringham, Everett, WA (US)

(73) Assignee: Travis Industries, Inc., Mukilteo, WA (US)

( * ) Notice: Subject to any disclaimer, the term of this patent is extended or adjusted under 35 U.S.C. 154(b) by 0 days.

(21) Appl. No.: 15/161,092

(22) Filed: May 20, 2016

(65) Prior Publication Data

US 2017/0016621 A1 Jan. 19, 2017

Related U.S. Application Data

(63) Continuation of application No. 13/492,585, filed on Jun. 8, 2012, now abandoned.

(60) Provisional application No. 61/494,798, filed on Jun. 8, 2011.

(51) Int. Cl.

| | |
|---|---|
| ***F24B 15/00*** | (2006.01) |
| ***F24B 1/181*** | (2006.01) |
| ***F23C 7/02*** | (2006.01) |

(52) U.S. Cl.

CPC ..... *F24B 15/005* (2013.01); *F23C 7/02* (2013.01); *F24B 1/181* (2013.01)

(58) Field of Classification Search

CPC ..... F23Q 7/02; F24B 15/005
USPC ..... 126/502, 500; 431/74, 72
See application file for complete search history.

(56) References Cited

U.S. PATENT DOCUMENTS

| | | | | |
|---|---|---|---|---|
| 6,615,820 | B1 * | 9/2003 | Ferreira | A47J 37/079 126/15 A |
| 2007/0107642 | A1 * | 5/2007 | Johnson | F23B 40/08 110/262 |
| 2007/0224560 | A1 * | 9/2007 | Stainrod | F24C 3/006 431/125 |
| 2008/0160470 | A1 * | 7/2008 | Holtan | F23B 50/12 431/331 |
| 2011/0005510 | A1 * | 1/2011 | Marple | F24B 1/1808 126/512 |

* cited by examiner

*Primary Examiner* — Avinash Savani
*Assistant Examiner* — Aaron Heyamoto
(74) *Attorney, Agent, or Firm* — Perkins Coie LLP

(57) ABSTRACT

A fireplace assembly having a firebox, an igniter assembly coupled to the firebox and containing a heating element, a first portion of the igniter assembly extending through an aperture in a firebox wall, the igniter assembly having a first connector coupled to the heating element and coupleable to power source, and having a second connector coupleable to an air source and positioned to provide air flow through the igniter assembly over the heating element and into the firebox. A controller is operatively coupled to the igniter assembly and a temperature sensor. The controller controls operation of the heating element, the temperature sensor, and the air flow through the igniter assembly, and can activate and deactivate the igniter assembly based upon the temperature within the firebox.

11 Claims, 8 Drawing Sheets

WOOD BURNING FIREPLACE ASSEMBLY WITH AUTOMATIC IGNITER

CROSS-REFERENCE TO RELATED APPLICATION(S)

This application is a continuation of U.S. patent application Ser. No. 13/492,585 filed Jun. 8, 2012 entitled WOOD BURNING FIREPLACE ASSEMBLY WITH AUTOMATIC IGNITER, which claims the benefit of U.S. Provisional Patent Application No. 61/494,798 filed Jun. 8, 2011 entitled WOOD BURNING FIREPLACE ASSEMBLY WITH AUTOMATIC IGNITER, both of which are incorporated herein by reference in their entireties.

TECHNICAL FIELD

Embodiments of the present invention are directed to fireplace assemblies, and more particularly to wood burning fireplace assemblies, including fireplaces, inserts and stoves.

BACKGROUND

Conventional wood burning fireplaces are configured to allow a user to load wood and other suitable solid fuel into the firebox in a selected arrangement before lighting the fuel to try to start the fire. Often a user must use a combination of paper, kindling, tinder, paraffin-based fire starter, or the like, to "start the fire" in a manner to cause the larger pieces wood to catch fire and to continue to burn. This manual process of lighting the fire can be time intensive, require multiple other materials, and can be frustrating if the fire won't "start" sufficiently to fully ignite the cut logs, rounds, or other larger pieces of wood. After the wood or other solid fuel has been ignited when initially manually starting the fire, the fuel often does not continue to burn and the fire will go out. Accordingly, the user must try to restart the fire and continue to tend the fire until the fuel is sufficiently hot so as to continue to burn without going out prematurely. There is a need for a system to assist in starting and maintaining a fire at a wood burning or other solid fuel burning fireplace assembly.

SUMMARY

The present invention is directed to a solid fuel burning fireplace assembly with an automatic ignition system that overcomes drawbacks experienced in the prior art and that provides additional benefits. In accordance with one embodiment, a fireplace assembly is provided for burning solid combustible fuel material. The fireplace assembly comprises a firebox having walls that define an interior area, and an igniter assembly coupled to the firebox. The igniter assembly contains a heating element. The assembly has an ignition end that extends through an aperture in one wall of the firebox. The ignition end is positioned in direct communication with the interior area, wherein the fuel material can be immediately adjacent to the ignition end. The igniter assembly has a rear portion exterior of the fire box. The rear portion has first and second connectors. The first connector is coupled to the heating element and is coupleable to power source. The second connector is coupleable to an air source and is positioned to provide air flow over the heating element and out of the ignition end and into the firebox for impingement with the combustible fuel.

A temperature sensor is connected to the igniter assembly and is configured to monitor the temperature within the firebox. A controller is operatively coupled to the igniter assembly and the temperature sensor. The controller controls operation of the heating element, the temperature sensor, and the air flow through the igniter assembly. The controller can activate and deactivate the igniter assembly based upon the temperature within the firebox as sensed by the temperature sensor.

Appendix A includes photographs of embodiments of the wood-burning fireplace assembly and features thereof.

DETAILED DESCRIPTION

The present disclosure describes solid fuel-burning fireplace assembly, such as a wood burning fireplace assembly, with an automatic igniter system in accordance with certain embodiments of the present invention. Several specific details of the invention are set forth in the following description and the Figures to provide a thorough understanding of certain embodiments of the invention. Many of the details, dimensions, angles, relative sizes of components, and/or other features shown in the Figures are merely illustrative of particular embodiments of the disclosure. Embodiments can have other details, dimensions, angles, sizes, and/or features without departing from the spirit and scope of the present disclosure. Moreover, certain features described with reference to specific embodiments may be combined with other embodiments of the disclosure. Other details describing well-known structures and components often associated with fireplace assemblies and methods of forming such assemblies, however, are not set forth below to avoid unnecessarily obscuring the description of various embodiments of the disclosure. One skilled in the art, however, will understand that the present invention may have additional embodiments, and that other embodiments of the invention may be practiced without several of the specific features described below.

Figure 1:
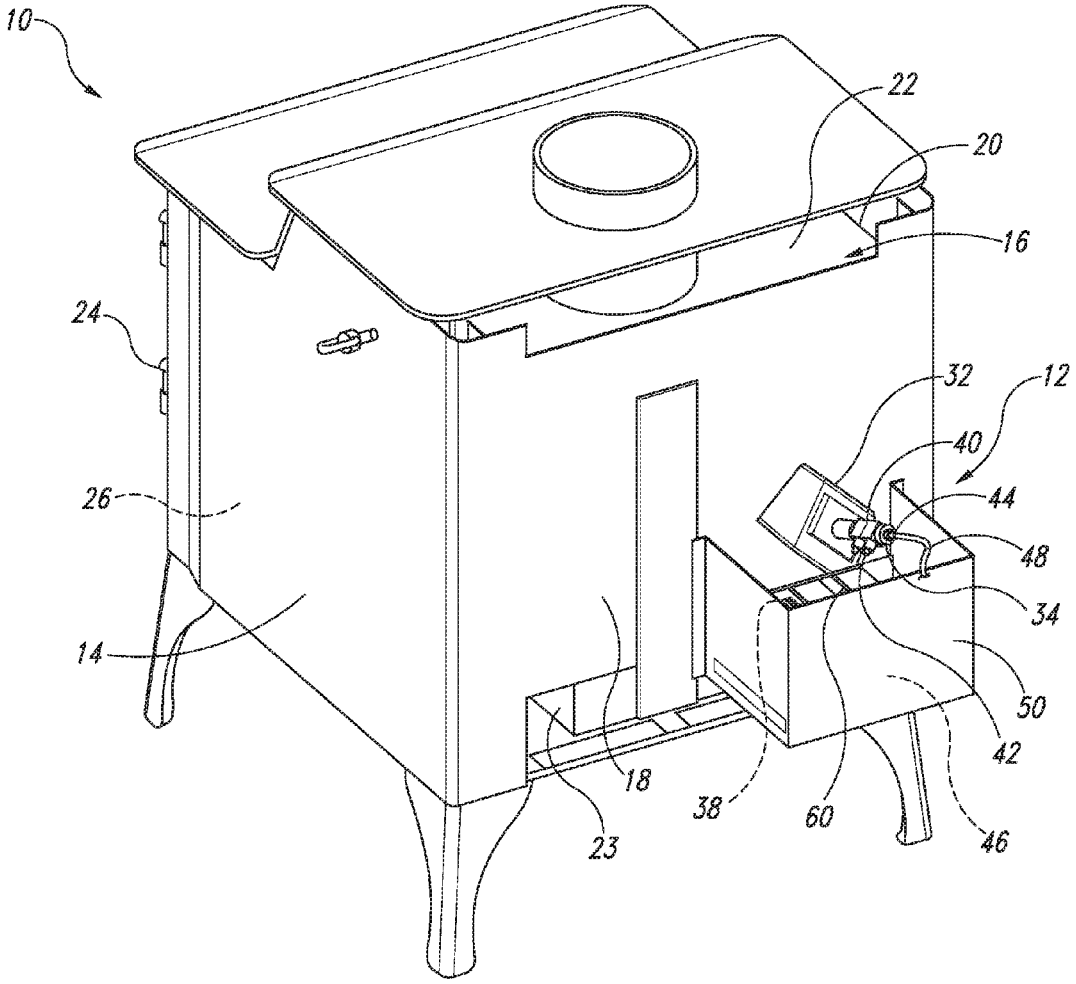
FIG. 1 is a rear isometric view of a wood-burning fireplace assembly with an automatic igniter system in accordance with aspects of the present invention.
Figure 2:
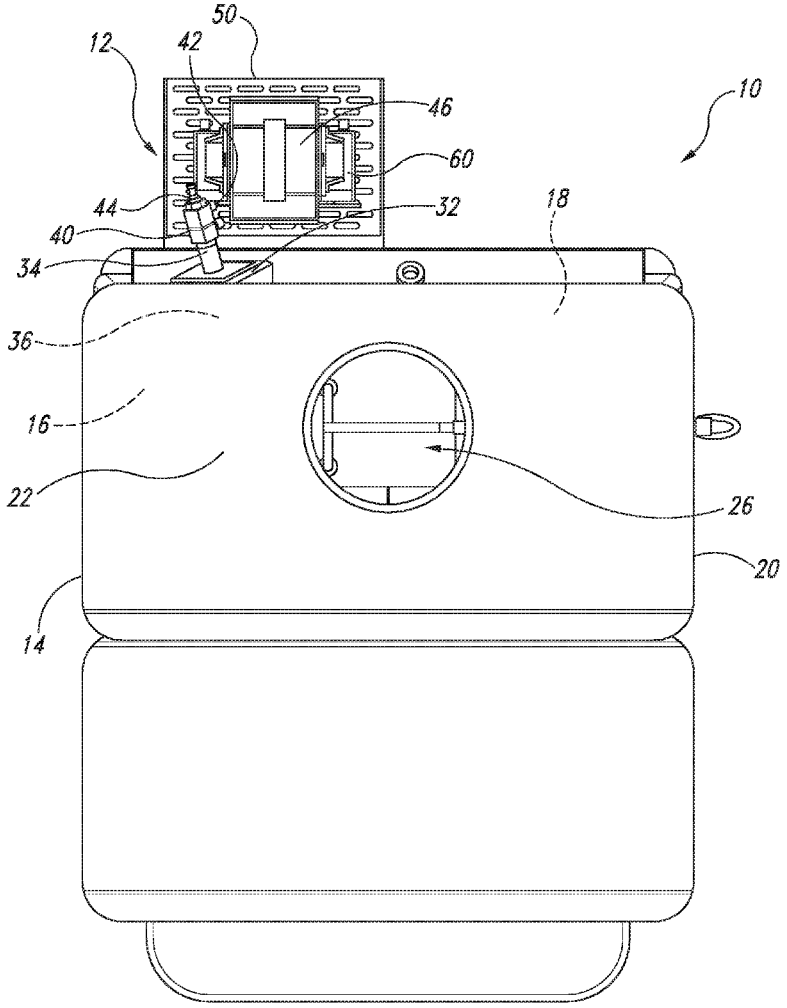
FIG. 2 is a top plan view of the wood-burning fireplace assembly with an automatic igniter system FIG. 1.
Figure 3:
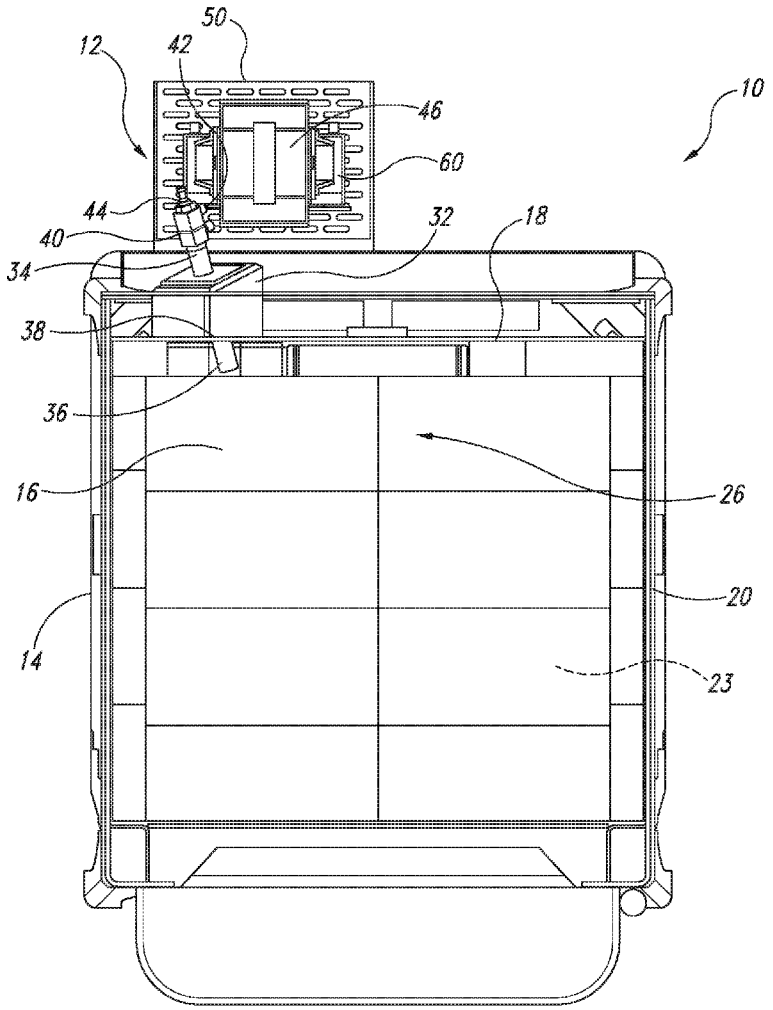
FIG. 3 is an enlarged cross-sectional plan view of the wood-burning fireplace assembly taken substantially along on line 3-3 of FIG. 1.
Figure 4:
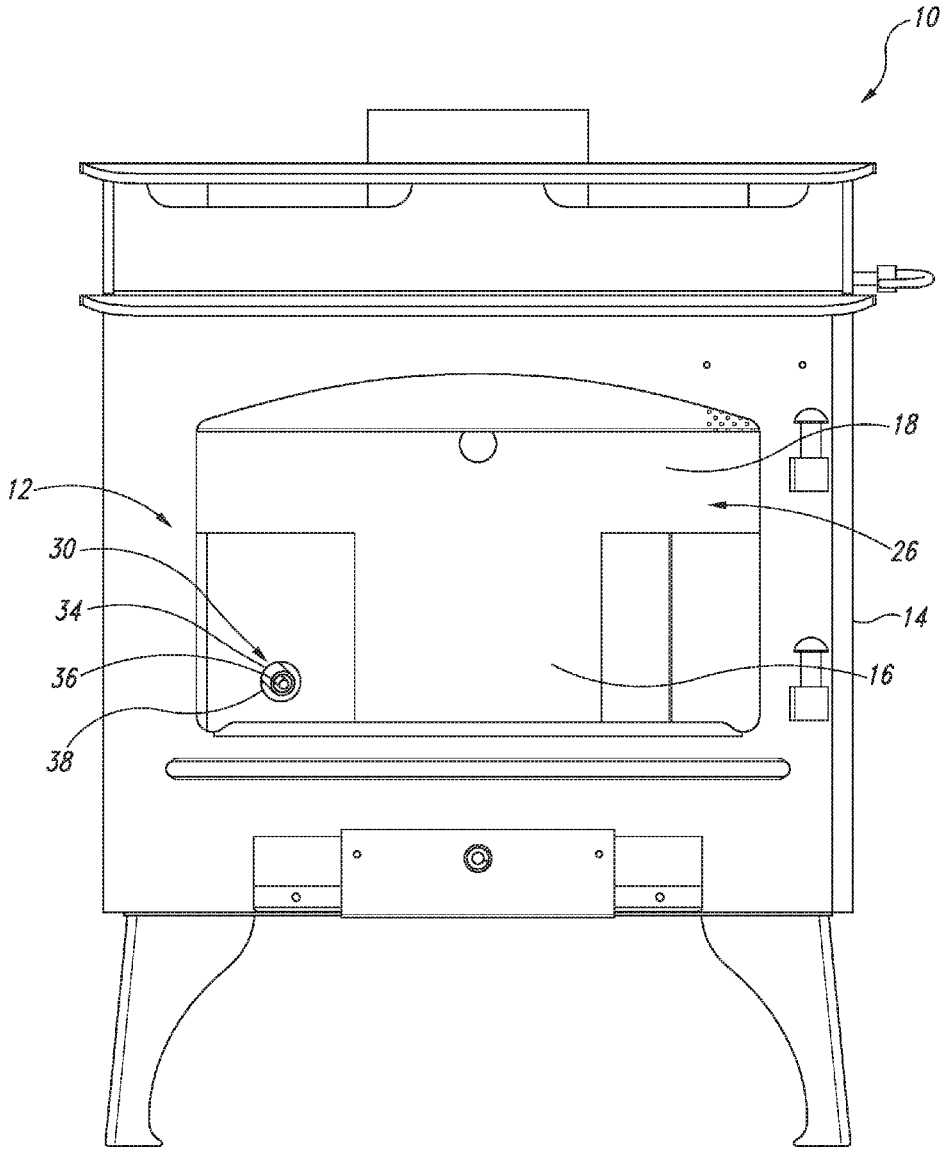
FIG. 4 is front elevation view of the wood-burning fireplace assembly with an automatic igniter system of FIG. 1.
Figure 5:
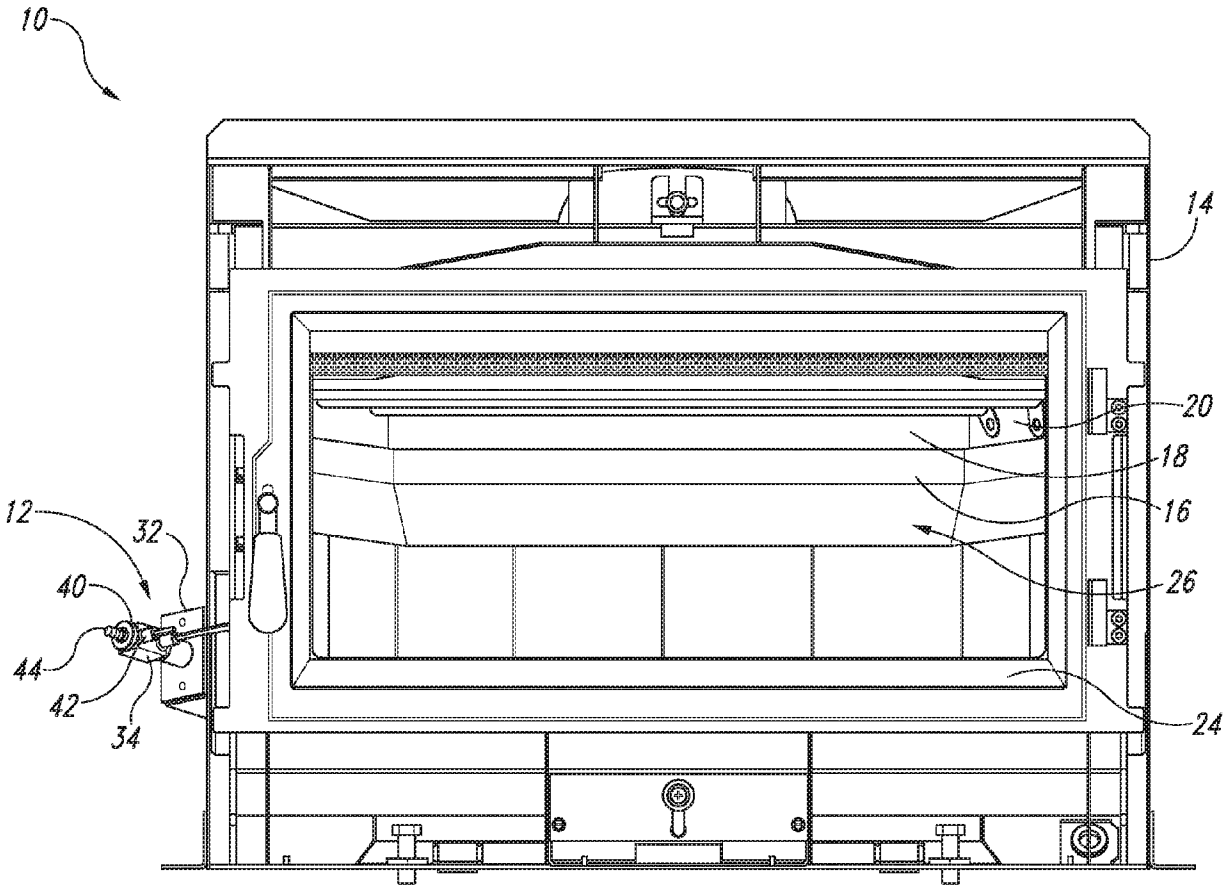
FIG. 5 is a front elevation view of a wood-burning fireplace assembly with an automatic igniter system in accordance with another embodiment.
Figure 6:
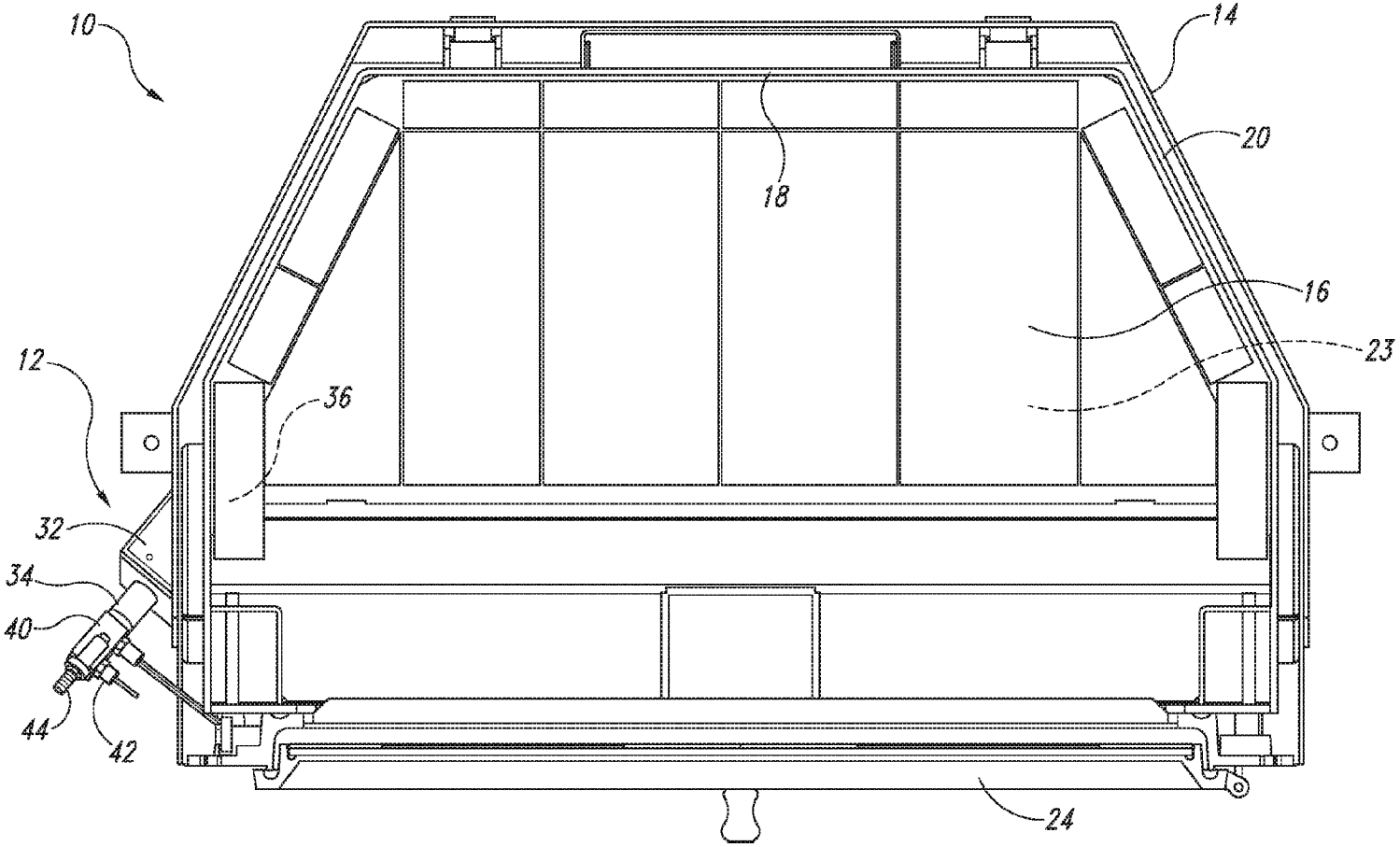
FIG. 6 is an enlarged cross-sectional plan view of the wood-burning fireplace assembly taken substantially along on line 6-6 of FIG. 5.
Figure 7:
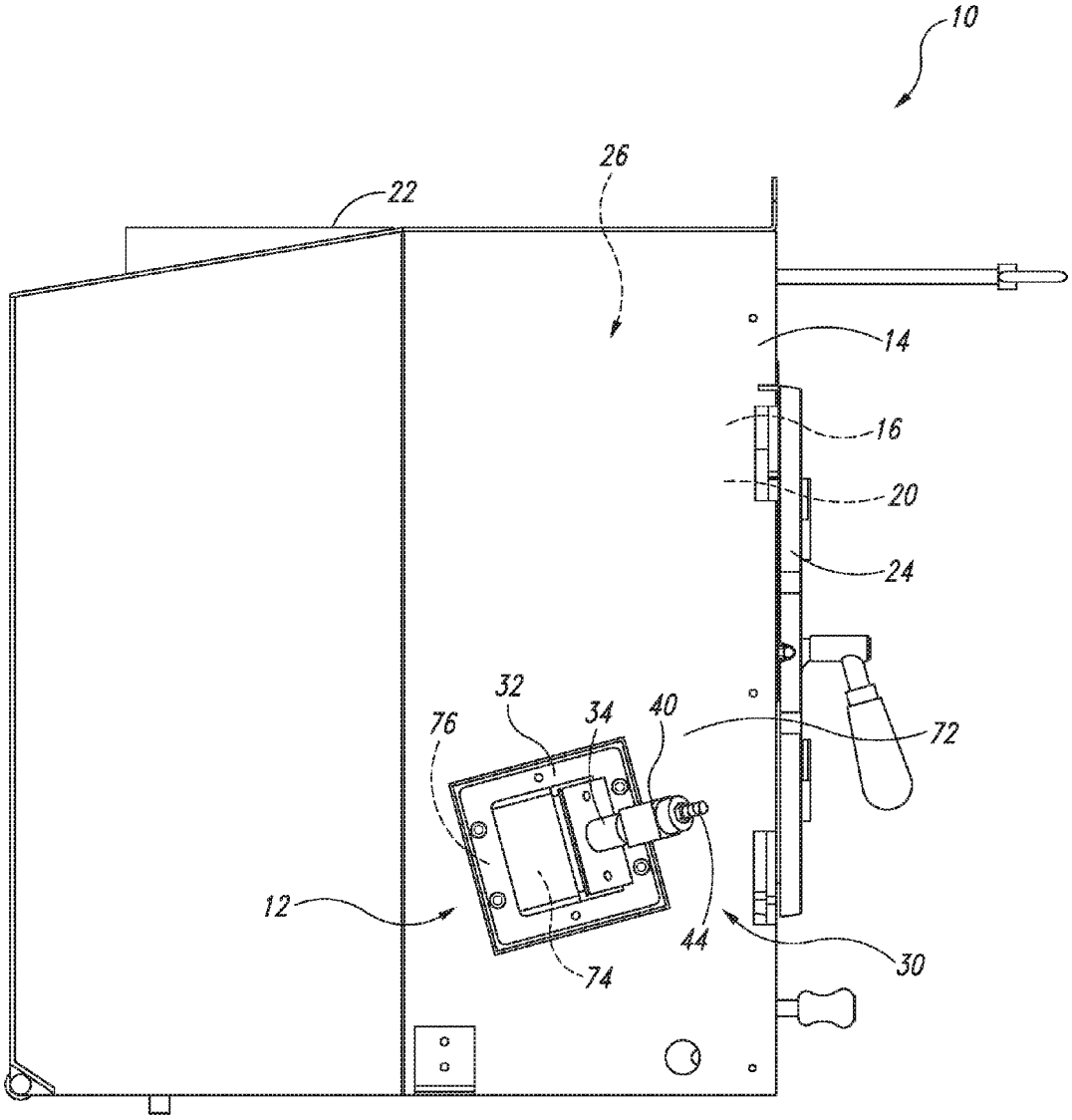
FIG. 7 is a side elevation of the wood-burning fireplace assembly of FIG. 5.
Figure 8:
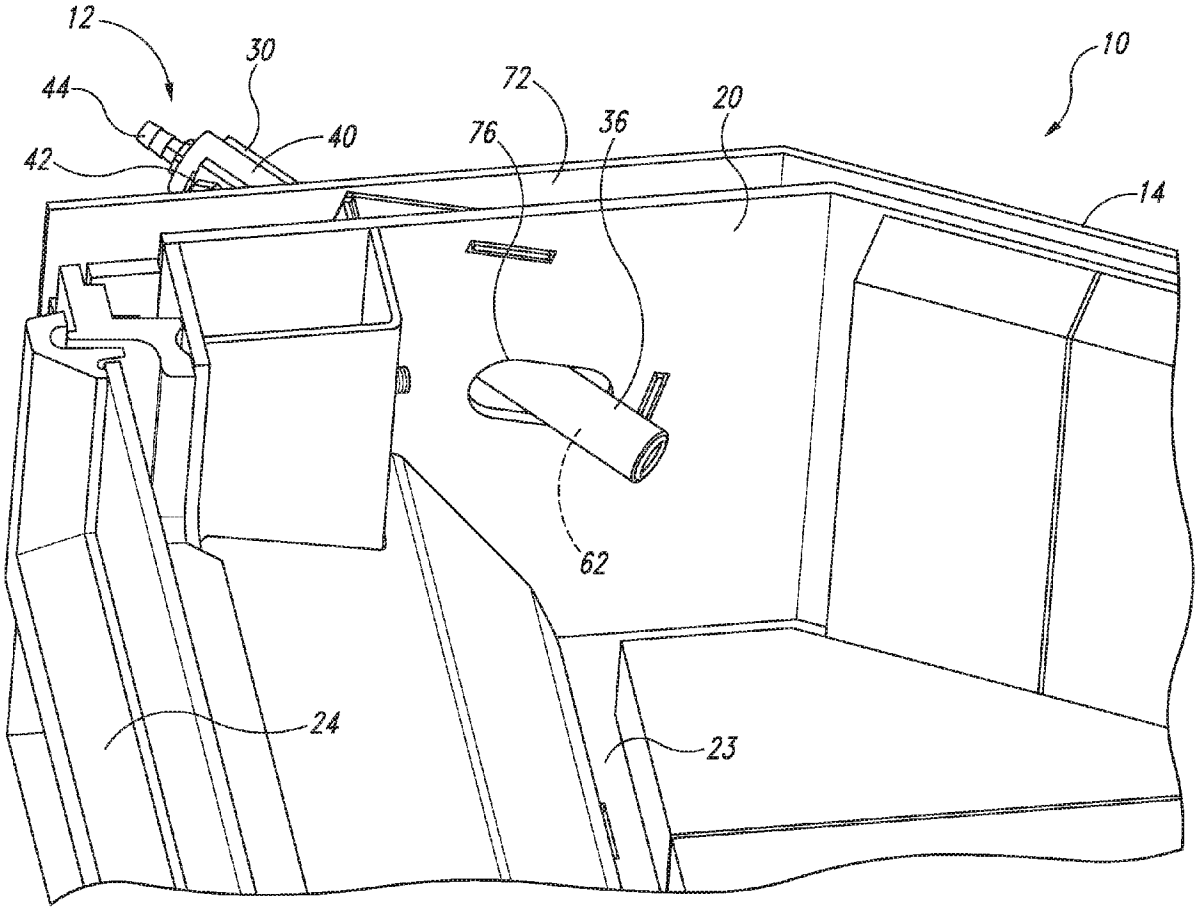
FIG. 8 is an enlarged, partially cut away isometric view of the assembly of FIG. 5 showing the igniter extending through a side wall.

FIGS. 1-4 are views of a wood-burning fireplace assembly 10 with an automatic igniter system 12 in accordance with one embodiment. The wood-burning fireplace assembly 10 of the illustrated embodiment has a fireplace housing 14 containing a firebox 16 (FIGS. 3 and 4). The firebox 16 is defined by a back wall 18, sidewalls 20, a top wall 22, and a bottom wall 23 all of which are sealably connected to each other to define an interior area 26. The front of the firebox 16 is closable by a door 24. The interior area 26 is configured to receive wood or other solid combustible fuel material and to contain the fuel when burning. The illustrated fireplace assembly 10 is a freestanding stove, although other embodiments can include fireplaces, inserts, or other stoves.

The assembly 10 of the illustrated embodiment includes an igniter assembly 30 coupled to the firebox 16 and configured to ignite the wood or other fuel within the firebox 16 so as to start a fire in the fireplace unit or to keep the fire going within the firebox 16, especially just after a fire is started and while the firebox 16 is not yet fully warmed up. The igniter assembly 30 includes a mounting assembly 32 attached to the wall of the firebox 16. In the illustrated embodiment, the mounting assembly 32 is mounted on the back wall 18 of the firebox 16, although the mounting assembly 32 can be mounted to other portions of the firebox 16 or to the fireplace housing 14 in other embodiments. The mounting assembly 32 is connected to and supports an igniter 34 in a selected location and orientation relative to the firebox 16 and the interior area 26. As best seen in FIGS. 3 and 4, the igniter 34 has an ignition end 36 that extends through an aperture 38 in the firebox's back wall 18, such that the ignition end 36 is located within or in direct communication with the interior area 26 in the firebox 16. The igniter 34 is configured to provide an ignition source, such as superheated air or other air source that generates sufficient heat to ignite the wood/fuel or to facilitate continued burning. In one embodiment, the aperture 38 through which the ignition end 36 of the igniter 34 extends is sealed so as to prevent exhaust from passing through the aperture 38 during operation of the fireplace assembly. Such a sealed arrangement is used when the fireplace assembly 10 includes a direct vent fireplace assembly.

The igniter 34 is mounted relative to the firebox so as to direct the superheated air downwardly toward the fuel area within the firebox 16 to facilitate initial combustion or continued combustions. The igniter 34 in other embodiments can be aimed in other manners as appropriate for the fireplace assembly. The ignition end 36 of the igniter 34 is positioned adjacent to the back wall 18 without projecting extensively into the firebox 16, thereby protecting the igniter's ignition end 36 from being damaged, for example, when wood or other fuel is added into the firebox 16 during operation of the fireplace assembly 10.

The igniter 34 of the illustrated embodiment in an electrical igniter that contains an electrical heating element that, upon activation, glows red-hot and generates sufficient heat to ignite the wood/fuel. In one embodiment, the igniter 34 is a Model HAC0030, manufactured by Tempco Mfg. A rear portion 40 of the igniter is exterior of the fire box and mounted to the mounting assembly 32. The rear portion 40 of the igniter 34 includes electrical connectors 42 that couple the igniter's electrical element (not shown) to a power source.

The rear portion 40 of the igniter 34 also includes a nipple 44 configured to attach to an air line 48, which is connected to an air supply 36 or other selected air source. In the illustrated embodiment, the air supply 46 is mounted to a support structure 50 attached to the back of the firebox 16. In other embodiments, the air supply 46 and/or the support structure 50 can be mounted in other locations while being coupled to the igniter 34 as described above.

The air supply 46 is configured to blow air through the air line 48, through the nipple 44, and through the igniter so the air flows over the heating element upon activation of the igniter assembly 30. The flow of air passing over the igniter's heating element is directed out of the igniter's ignition end 36, thereby driving superheated air into the firebox 16 and against the wood or other fuel therein.

The igniter 34 and the air supply 46 are operatively connected to a controller 60, which is configured to control operation of the igniter assembly 34. The controller 60 can be activated so as to control the igniter 34 and the air supply 46 via controls mounted on the fireplace assembly 10 and/or via a remote control device that wirelessly communicates with the controller 60. The controller 60 of the illustrated embodiment can be a Viking Model RC2A Remote Touch Tone Relay Controller manufactured by Viking Electronics of Hudson, Wis. Other embodiments can use other controllers.

The controller 60 can be configured to provide a plurality of operation modes of the igniter assembly 30. For example, the controller 60 in one embodiment is configured with a "start mode" for use when initially starting a fire in the firebox. In the start mode, the controller 60 activates the igniter 34 and the air supply 46 so as to provide a substantially continuous flow of superheated air into the firebox that blows against the wood/fuel therein until the wood/fuel is heated to its ignition temperature, thereby starting the wood/fuel to burn. The air supply 46 and the igniter 34 remain on for a selected period of time to ensure that the fire is started in the firebox 16.

In one embodiment, the "start mode" can end after the fire has started or after a selected time period has elapsed. In another embodiment, the "start mode" can include a post-start, "sustain mode" wherein the air supply 46 and igniter 34 are cycled off and on for selected time periods after the fire is initially started to cyclically provide the superheated air to the fuel that will support continued burning of the fuel in the firebox 16. In another embodiment, the "sustain mode" can be a distinct mode separate from the "start mode" that a user can select when activating the ignition system 30. The controller 60 can also include other modes, such as a "new fuel mode," wherein the igniter 34 and air supply 46 may be activated continuously or cyclically for one or more selected periods of time when or just after new fuels has been added into the firebox 16. The controller 60 can also be configured to independently activate the air supply 46 when the igniter 34 is turned off, thereby directing a flow of non-heated focused combustion air to the burning fuel. Accordingly, the air supply 46 can be used as a focused air flow to "fan the fire."

In one embodiment, the igniter assembly 30 can include or be connected to one or more temperature sensors 62 coupled to the controller 60 that monitor the temperature within the firebox 16. The controller 60 can activate or deactivate the igniter 34 based upon the temperature within the firebox 16 as sensed by the temperature sensor(s). For example, if the temperature within the firebox 16 is below a threshold level, the controller 60 can activate the igniter 34 and air supply 46 so as to initiate and/or sustain combustion of the fuel in a firebox 16 until the temperature in the firebox has exceeded the threshold level. After the sensors 62 indicate that temperature has exceeded the threshold level, the controller 60 can deactivate or turn off the igniter 34 and/or the air supply 46. In one embodiment, if the temperature sensors indicate that the temperature within the firebox 16 drops below load a threshold level, the controller 60 can reactivate the igniter assembly 30 so as restart or keep the fire burning in the firebox 16. The controller 60 can also be configured to turn off the igniter assembly 30 if, as an example, a selected amount of time has elapsed and if the temperature in the firebox 16 has not exceeded the threshold level, which may indicate that there is no longer enough wood or other fuel in the firebox to sustain a fire.

The illustrated embodiment shows a single igniter assembly 30 mounted to the back of the firebox 16. Other embodiments can include a plurality of igniter assemblies coupled to one or more controllers 60. Each igniter assembly 30 can be connected to a dedicated air supply. In other embodiments, multiple igniters 34 can be coupled to a single air supply.

The controller of the igniter 34 is mounted to the back wall and oriented so as to direct the superheated air downwardly toward the fuel area within the firebox 16 the igniter 34 in other embodiments can be aimed in other manners as appropriate for the fireplace assembly. The ignition end 36 of the igniter 34 is positioned adjacent to the back wall 18 without projecting extensively into the firebox 16, thereby protecting the igniter's ignition end 36 from being damaged for example when wood or other fuel is added into the firebox 16 during operation of the fireplace assembly 10.

FIGS. 5-8 are views of a wood-burning fireplace assembly 10 with an automatic igniter system 12 in accordance with an alternate embodiment. In this alternate embodiment, the automatic igniter system 12 includes the mounting assembly 32 and the igniter 34 mounted to a side panel 72 of the fireplace housing 14. The side panel 72 can be a separate panel spaced apart from one of the side walls 20 of the firebox 16. The side panel 72 has an aperture 74 and the adjacent sidewall 20 has a coaxial the aligned aperture 76 through which the igniter 34 extends. In this embodiment, the ignition end 36 of the igniter 34 is positioned adjacent to the sidewall 20 of the firebox 16, and the igniter 34 is aimed at so as to direct the flow of air on to the wood or other fuel in the firebox 16 as discussed above. The aperture 76 in the sidewall 20 of the firebox 16 can be sealed to maintain a substantially sealed firebox during operation of the fireplace assembly 10.

In this alternate embodiment, the igniter 34 is connected to an air supply 46 and a controller 60 in a manner similar as discussed above, and the controller 60 is configured with one or more of the operational modes that a user can select to start or maintain a fire in the firebox. In the illustrated embodiment, a single igniter assembly 30 is provided on one side of the fireplace assembly 10. In another embodiment, an igniter assembly 30 can be provided on each side of the fireplace assembly 10. In yet another embodiment.

In operation, when a user wants to start a fire in the fireplace assembly 10, the user opens the door 24, places wood, kindling, paper, or other fuel in the firebox 16 in alignment with the ignition end 36 of the igniter, thereby preparing or "setting" the fire. While the user is setting the fire, the igniter assembly remains in an "off" condition. The door 24 or the firebox 16 may be configured with one or more sensors connected to the controller 60 to determine if the door is open or fully closed. The controller 60 can be configured to activate the igniter 34 only is the door 24 is fully closed. The igniter 34 will be automatically turned off when the door 24 is opened.

After the user has set the fire and fully closes the door 24, the user activates the controls on the fireplace assembly 10 or on a remote controller, so as to select an operation mode of the igniter assembly 30. For example, the user can select the "start" mode, wherein the controller 60 actives the air supply 46 and the igniter 34 to direct heated air into the set fuel until the temperature of the fuel increases to or past the ignition or flash point, thereby causing the fuel to catch fire. The user can also select an operation mode wherein the igniter assembly 30 is automatically intermittently turned on and off so as to ensure that the fuel continues to burn. In another embodiment, the user can manually light the fire in the firebox 16 before closing the door 24, and after the door 24 is closed, the igniter assembly 30 can be activated in a "sustain" mode to direct the superheated air to the fuel to keep the fire burning. After the fire is going continuously and/or when the temperature in the firebox 16 has exceeded a threshold level, or after a predetermined time period has elapsed, the controller 60 can automatically turn off the igniter assembly 30.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A fireplace assembly for providing fire burning solid combustible fuel material, comprising:

a housing containing a firebox, the firebox having at least first and second walls that define a sealed interior area, at least a portion of the first wall is a door movable between open and closed positions;

an igniter assembly coupled to the firebox and containing a heating element, the igniter assembly having an ignition end extending through an aperture in the second wall and terminating at the aperture, the ignition end being positioned in direct communication with the interior area, the igniter assembly having a rear portion exterior of the firebox;

an air supply assembly connected to the rear portion of the igniter assembly and activatable to blow air flow through the igniter assembly over the heating element and out of the ignition end and into the firebox for impingement with the combustible fuel;

a temperature sensor connected to the igniter assembly and to the firebox, the temperature sensor positioned at least partially within the firebox to monitor the temperature within the firebox; and a controller having controls mounted on the housing and being operatively coupled to the igniter assembly, the air supply assembly, the door sensor, and the temperature sensor, the controller controlling operation of the heating element, the temperature sensor, and the air flow through the igniter assembly, wherein the controller is configured to activate the igniter assembly only when the door sensor indicates the door is in the closed position, the controller is configured to activate and deactivate the igniter assembly based upon the temperature within the firebox as sensed by the temperature sensor, wherein the igniter assembly is activated when the temperature in the firebox is less than a threshold temperature and deactivated when the temperature in the firebox exceeds the threshold temperature, the controller being configured to deactivate the igniter assembly after a defined period of time within which the temperature in the firebox has not exceeded the threshold temperature, the controller having a plurality of operation modes configured for use in starting and maintaining a fire in the firebox based upon the temperature within the firebox as sensed by the temperature sensor.

2. A wood-burning fireplace assembly, comprising:

a fireplace housing containing a firebox defined by a plurality of walls sealably interconnected to define an interior area configured to contain solid combustible fuel material for burning in the firebox;

an igniter assembly coupled to the firebox and configured to ignite the solid combustible fuel within the interior area so as to start a fire in the interior area or to keep the fire going within the firebox, the igniter assembly has ignition end that extends through a sealed aperture in a first wall of the plurality of walls, such that the ignition end is located in direct communication with the interior area, a rear portion of the igniter assembly is exterior of the firebox;

an air source with an air line connected to the rear portion of the igniter assembly, the air source is configured to blow air through the air line and through the igniter assembly and out the ignition end, thereby driving superheated air into the firebox and against the solid combustible fuel;

a controller having controls mounted on the fireplace housing and operatively coupled to the igniter assembly and the air supply, the controller being configured to control operation of the igniter assembly, the controller having a plurality of operation modes of the igniter assembly, and a temperature sensor connected to the igniter assembly and positioned at least partially in the firebox, the temperature sensor being coupled to the controller and configured to monitor the temperature within the firebox;

wherein the controller is configured to activate or deactivate the igniter based upon the operation mode selected with the controls of the remote controller and based upon the temperature within the firebox as sensed by the temperature sensor, and wherein the igniter assembly is activated when the temperature in the firebox is less than a threshold temperature and deactivated when the temperature in the firebox exceeds the threshold temperature, the controller being configured to deactivate the igniter assembly after a defined period of time within which the temperature in the firebox has not exceeded the threshold temperature, the controller having a plurality of operation modes configured for use in starting and maintaining a fire in the firebox based upon the temperature within the firebox as sensed by the temperature sensor.

3. The fireplace assembly of claim 1 wherein the controller is configured with a start mode configured for use in starting a fire in the firebox, a sustain mode configured for sustaining the fire in the firebox based upon the temperature in the firebox relative to a threshold temperature within the firebox.

4. The fireplace assembly of claim 3 wherein the controller is configured with a fanning mode wherein the controller activates the air source while the igniter remains off.

5. The fireplace assembly of claim 3 wherein the controller is configured to deactivate the igniter after a defined period of time if the temperature within the firebox detected by the temperature sensor is below the threshold temperature.

6. The fireplace assembly of claim 2 wherein the controller is configured with a start mode configured for use in starting a fire in the firebox, a sustain mode configured for sustaining the fire in the firebox based upon the temperature in the firebox relative to a threshold temperature within the firebox.

7. The fireplace assembly of claim 6 wherein the controller is configured with a fanning mode wherein the controller activates the air source while the igniter remains off.

8. The fireplace assembly of claim 6 wherein the controller is configured to deactivate the igniter after a defined period of time if the temperature within the firebox detected by the temperature sensor is below the threshold temperature.

9. The fireplace assembly of claim 2 wherein at least a portion of one of the walls is a door movable between open and closed positions, and the fireplace assembly further comprising a door sensor coupled to the door and positioned to detect whether the door is in the closed position, and the controller is coupled to the door sensor and is configured to activate the igniter assembly only when the door sensor indicates the door is in the closed position.

10. The fireplace assembly of claim 2, further comprising second controls connected to the fireplace housing and coupled to the controller, the second controls being activatable to select one or more of the operation modes of the igniter assembly; and wherein the controller is configured to activate or deactivate the igniter based upon the operation mode selected with the second controls and the temperature within the firebox as sensed by the temperature sensor.

11. The fireplace assembly of claim 2, further comprising a remote control device with controls operatively coupled to the controller and activatable to select one or more of the operation modes of the igniter assembly.

* * * * *